United States Patent [19]

Reardon et al.

[11] Patent Number: 4,558,576

[45] Date of Patent: Dec. 17, 1985

[54] AUTOMATIC GAUGE CONTROL SYSTEM FOR MULTI-STAND TIED BLOCK ROD ROLLING MILL

[75] Inventors: Richard J. Reardon, Boylston; Endre S. Maroti, Shrewsbury; Colin Roy, Worcester; John S. Lindsay, Shrewsbury, all of Mass.

[73] Assignee: Morgan Construction Company, Worcester, Mass.

[21] Appl. No.: 550,800

[22] Filed: Nov. 14, 1983

[51] Int. Cl.[4] ..... B21B 37/12

[52] U.S. Cl. ..... 72/9; 72/12; 72/16; 72/234

[58] Field of Search ..... 72/8, 11, 16, 235, 9, 72/12, 234

[56] References Cited

U.S. PATENT DOCUMENTS

| | | | |
|---|---|---|---|
| 3,036,480 | 5/1962 | Schwab | 72/234 X |
| 3,433,037 | 3/1969 | Lemon | 72/234 X |
| 3,526,113 | 9/1970 | McNaugher | 72/16 |
| 3,787,667 | 1/1974 | King et al. | 72/8 X |
| 3,802,235 | 4/1974 | Fox | 72/16 |
| 4,485,497 | 12/1984 | Miura | 72/8 X |

FOREIGN PATENT DOCUMENTS

| | | | |
|---|---|---|---|
| 24261 | 8/1975 | Japan | 72/16 |
| 24507 | 3/1981 | Japan | 72/16 |

*Primary Examiner*—E. Michael Combs
*Attorney, Agent, or Firm*—Maurice E. Gauthier

[57] ABSTRACT

The dimensions of a product passing through the finishing block of a roll rolling mill are measured. Where the dimensions of the product exiting the last finishing stand are out-of-tolerance, a calculation is made to determine the extent to which the roll parting of the work rolls of one of the two last finishing stands must be adjusted to bring the product into tolerance. Based on the calculated adjustment, progressively smaller adjustments are made to the roll partings of the work rolls of the upstream finishing stands to distribute the work which must be performed on the product to bring the product into tolerance.

9 Claims, 17 Drawing Figures

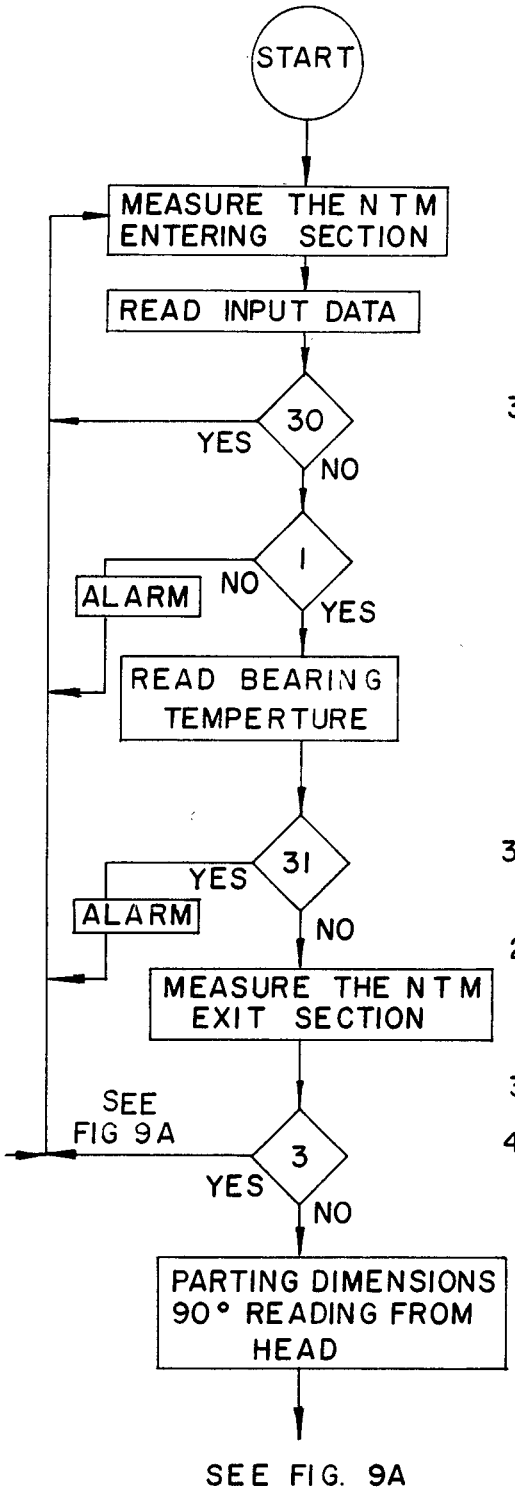

1-IS THE ENTERING SECTION WITHIN TOLERANCE.

30-HAS ANY OF THE INPUT DATA CHANGED. IF NOT THEN CONTINUE. OTHERWISE RECORD IT AND LOOP AGAIN FOR A DOUBLE CHECK.

INPUT DATA CONSISTS OF:
1-ENTERING SECTION LIMITS.
2-EXIT SECTION LIMITS.
3-ABSOLUTE PARTING LIMITS ON EACH STAND.
4-MAX ADJUSTMENT ON LEADER AND FINISHES AS % OF TARGET.
5-TEMPERTURE LIMIT FOR EACH BRG.
6-TARGET DIMENSIONS.

31-ARE ANY BEARING TEMPERTURES TOO HOT.

2-ASSUME THAT THE SMALLER DIMENSION IS THE HEAD.

3-ARE THE DIMENSIONS WITHIN TOLERANCE.

4-ARE THE MEASUREMENTS AFTER THE ADJUSTMENTS BETTER THAN THE ONES MADE BEFORE.

4.5-IS THIS THE SECOND TIME THROUGH THIS LOOP WITHOUT AN IMPROVEMENT.

Fig. 9

AUTOMATIC GAUGE CONTROL SYSTEM FOR MULTI-STAND TIED BLOCK ROD ROLLING MILL

BACKGROUND AND BRIEF SUMMARY OF THE INVENTION

The invention relates to a system for automatically controlling the gauge of rod being rolled in the finishing block of a rod rolling mill.

Rolling mills produce rod by rolling heated billets through a series of roll stands. As described for example in U.S. Pat. No. 3,336,781, the final or "finishing" stands are conventionally grouped into a finishing block. The roll axes of successive roll stands in the finishing block are orientated 90 degrees in relation to each other in order to avoid having to twist the product. As the rod passes through each pair of rolls, its cross-sectional area is progressively reduced. The roll partings of each pair of rolls are adjustable to control the reductions being taken.

The rod dimensions are determined either by an on line gauge measurement or by cropping rod samples which are measured off line. When an off-gauge situation is encountered in the rolling of steel rod, depending on the severity of the problem, the remaining billet length will either continue to be rolled through the finishing block, or it will be diverted to crop shears for subdivision into scrap lengths. Thereafter, roll parting adjustments will be performed under "no load" conditions before rolling is resumed. Thus, in conventional mills, the inherent time lag between detection of an off-gauge situation and the performance of required corrections results either in the rolling of substantial amounts of off-gauge product, or in aggravated circumstances, the scrapping of valuable product. Moreover, the manual performance of roll parting adjustments requires highly skilled and attentive operating personnel. Where such personnel are unavailable, the operating efficiency of the mill is reduced even further. There is, therefore, a need for a system which will automatically determine when a rod is out of tolerance and promptly effect the necessary roll parting adjustments while the mill continues to roll product and without operator intervention.

The present invention is directed to a system for monitoring the dimensions of a product passing through the finishing block or a rod rolling mill and for automatically controlling the roll partings of at least one pair of rolls in the finishing block based on the aforesaid monitored dimensions. The roll partings are adjusted under load, thereby eliminating the substantial time lag currently experienced in conventional installations.

Broadly, the invention embodies a control system which monitors the dimensions of the product entering and leaving the finishing block. The system includes a CPU and peripheral devices which communicate via compatible interfaces. A first data station reads the dimensions of the product prior to its entering the first finishing stand. If these read dimensions exceed pre-established tolerance limits, an alarm condition is created. Based on the extent that the product is out of tolerance, a decision is made as to whether to continue to roll the rod through the finishing stands, or alternatively have the rod bypass the finishing stands for cropping into scrap lengths.

From each of the finishing stands, information is provided to the CPU corresponding to: drive shaft torque; separating force; roll shaft bearing temperature; and, the parting dimension between rolls. From the CPU, commands are sent to a position sensor to control roll parting. Drive shaft torque and roll separating force jointly correspond to the work load of the rolls. If this load exceeds a pre-established limit, an alarm condition is created. If the bearing temperature exceeds a pre-established limit, then an alarm condition is created.

A second data station reads the dimensions of the product after it leaves the last finishing stand. If these dimensions exceed pre-established limits, then an analysis is made to determine if the roll partings of the finishing stand can be adjusted to bring the product rod within tolerance. Depending upon the amount the product is out of tolerance the parting dimension(s) of the rolls of only one finishing stand, some of the finishing stands or all of the finishing stands may be adjusted. The difference between the in tolerance (target) dimension and the out-of-tolerance dimension is calculated and used as the dimension (calculated adjustment) the rolls of the last finishing stand must be adjusted to bring the product into tolerance. The work to be performed on the product is distributed among the finishing stands. Progressively smaller roll parting adjustments (cascade adjustments) for the finishing stands preceeding the last finishing stand are calculated based on the calculated adjustment to the rolls of the last finishing stand. Preferably, these cascaded adjustments are in reciprocal geometric progression.

After the cascade adjustments are calculated, a determination is made to ascertain if the rolls can actually be adjusted the calculated amount. This determination is a two step procedure. The first step analyses whether or not the proposed adjustments are within reasonable limits. If they are, then second step analyses whether the new roll partings are achievable.

The first step compares the calculated adjustments to be made to the roll partings of each finishing stand to pre-established limits. The limits function as a window to exclude unacceptable data. If the limits are exceeded an alarm condition is created. If these limits are not exceeded then the second step compares the calculated adjustments for each of the roll partings to the actual position of the rolls to determine if the rolls of each finishing stand are capable of opening or closing the actual distance required. If they are, then the roll parting adjustments are made.

This sequence of steps calculates what adjustments to the rolls are necessary to bring the product into tolerance and whether or not the roll parting adjustments are possible. The roll parting adjustments of all finishing stands are based on a reciprocal geometric progression from the last finishing stand to the first, thereby distributing among the finishing stands the work which must be performed upon the product to bring the product into tolerance. If the adjustments are possible, then the roll parting between the rolls of at least one finishing stand is adjusted. If the adjustments are not possible, then an alarm condition is created.

The invention provides for on line roll parting adjustments in a twist-free finishing mill. The response time between detection of out of tolerance product and roll parting adjustments is within seconds, and the roll parting adjustments are made under load.

DESCRIPTION OF THE PREFERRED EMBODIMENT

Figure 1:
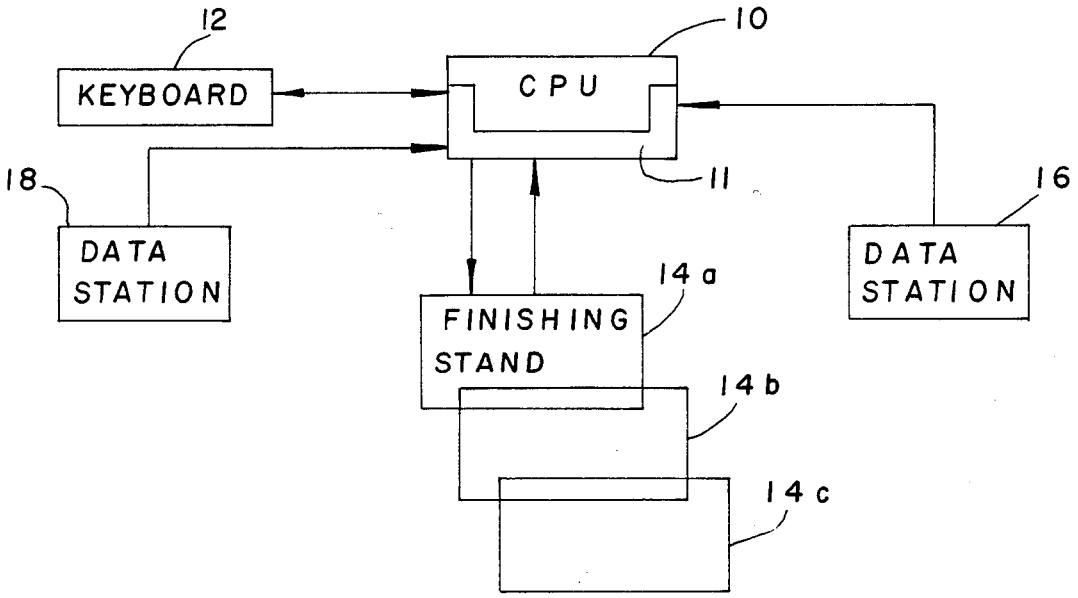
FIG. 1 is a functional block diagram of a system embodying the invention.

The invention will be described with reference to a ten stand twist-free finishing block in a steel rod rolling mill. Referring to FIG. 1, a computer 10, such as a PDP-11 having 128K-word memory, communicates with a keyboard 12, finishing stands 14*a–j*; a data station 16 and a data station 18.

Control of the computer 10 is accomplished through instructions which are written in terms of the particular mode of operation desired. The computer thus has stored in its memory, the programs or routines corresponding to each mode of operation of the computer. It is well known to those skilled in the art that the computer comprises suitable control, storage and computational units for performing various arithmetic and logical functions on data which it processes in digital form. Any standard computer language consistent with the capability of the computer can be used with the instructions. All subroutines are not described in detail, since they can be written with any desired notations, formats or sequence, depending upon the particular computer being utilized, computer language, etc. Programs and instructions described are put in terms of structural flow. When necessary and applicable for purposes of the invention, individual programs are described. For the computer 10, the manufacturers handbook sets forth the necessary program which includes the sequence of internal interconnections which have been added by the preparation and loading of the programs into the internal memory of the computer. The computer 10, as shown in FIG. 1, interfaces with the data stations 16 and 18 and the finishing stands 14*a–j* through an interface 11, such as a 16-bit I/O module AD-RTI-1250. The computer has 16-bit word-length, Floating point arithematic and 128-K words of memory. All instructions are entered into the computer through the keyboard 12 and all processing is performed in the computer.

Programs are written in both Fortran and assembly language modules. The assembly language modules are used to implement the interface handler and to perform manipulations which are not suited for Fortran, such as byte (8 bit) mode arthimetic and bit-based computations. Approximately 40-K words are available for application dependent programs.

Figure 2:
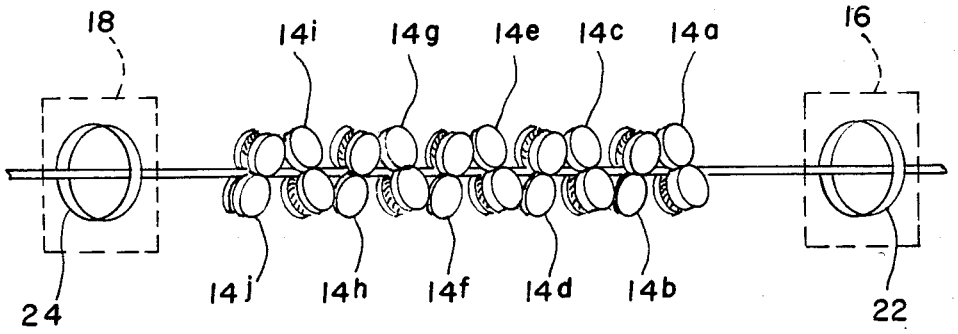
FIG. 2 is a schematic illustration of a series of work roll pairs in the finishing block of a rolling mill.

Referring to FIG. 2, a ten stand rod finishing block is shown schematically wherein the data stations 16 and 18 and the work rolls of each finishing stand are illustrated. The basic design and operation of the finishing block are well known to those skilled in the art, as shown for example in U.S. Pat. No. 3,336,781. The modifications made to the finishing stands disclosed in that patent, which patent is herein incorporated by reference in its entirety in this disclosure, relate primarily to the replacement of the manually operable roll parting adjustment mechanisms by power screw-down mechanisms, also of known design, having digital screw position indicators.

Figure 3:
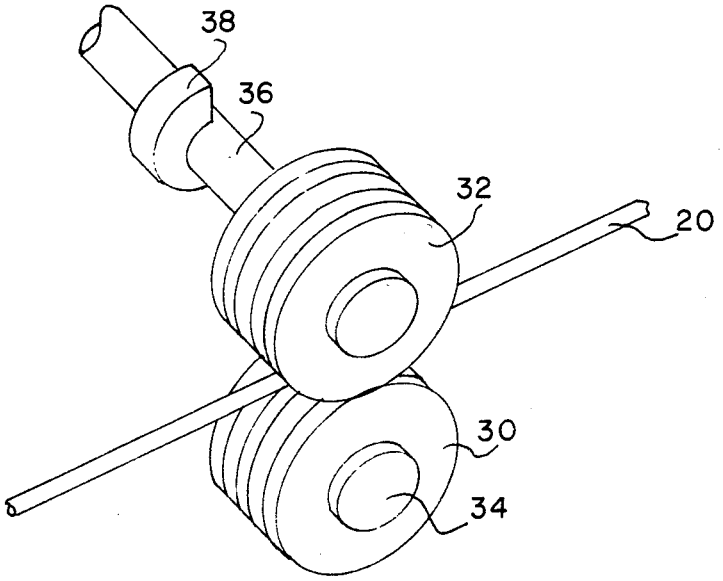
FIG. 3 is a schematic illustration of a single pair of work rolls.

Referring to FIG. 3, two rolls 30 and 32 are mounted respectively on driven roll supporting shafts 34 and 36. A sensor 38, such as for example a Indikon Q6871, is associated with the roll supporting shaft 36. Sensor 38 measures the separating forces between the rolls. A torque sensor (not shown) also is associated with the intermediate drive train which powers the roll support shafts 34 and 36. These sensors, in combination, are indicative of the work being performed by the work rolls. Roll bearing temperaure sensors (not shown) such as STC-GG-T-30-36-STD monitor the temperatures of the roll support shaft bearings.

Figure 4:
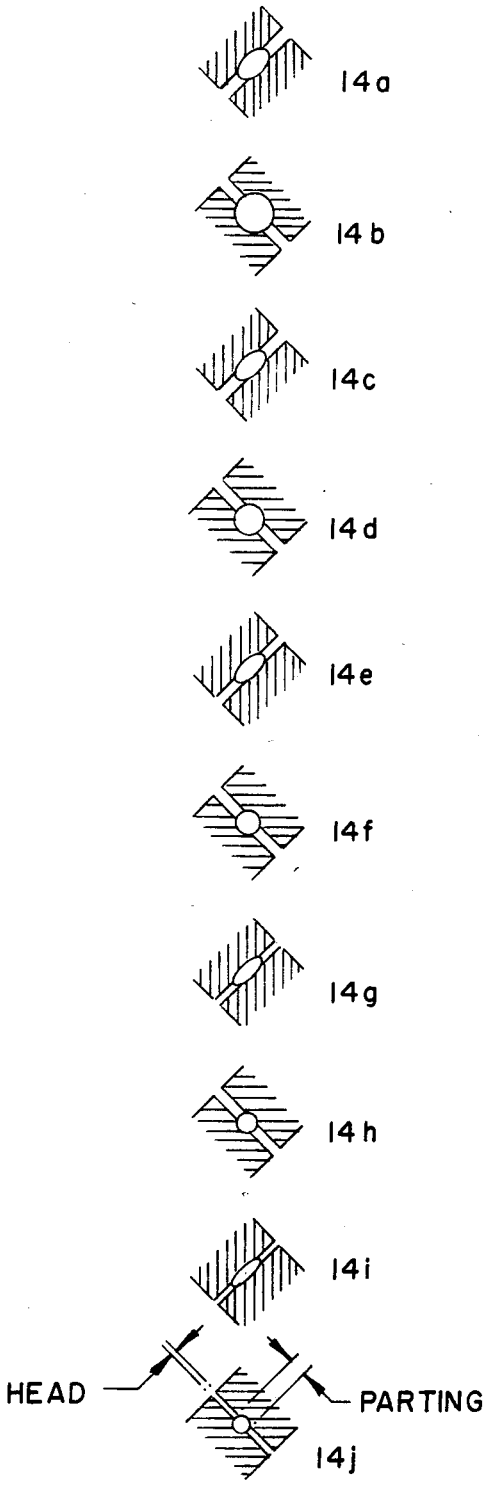
FIG. 4 is an illustration of the roll pass sequence.

Referring to FIGS. 2, 3 and 4, product 20 is rolled by the work roll pairs of finishing stands 14*a–j*. The axes of the work rolls of successive roll pairs are orientated at right angles with respect to each other. This relationship is illustrated in FIGS. 2 and 4. The cross-sectional dimensions of the product 20 prior to the first finishing stand 14*a* are read by a scanning laser gauge 22 at data station 16. The dimensions of the product 20 after leaving the finishing stand 14*j* are read by a scanning laser gauge 24 at data station 18. The dimensions read are the maximum and minimum dimensions at each data station.

Figure 5:
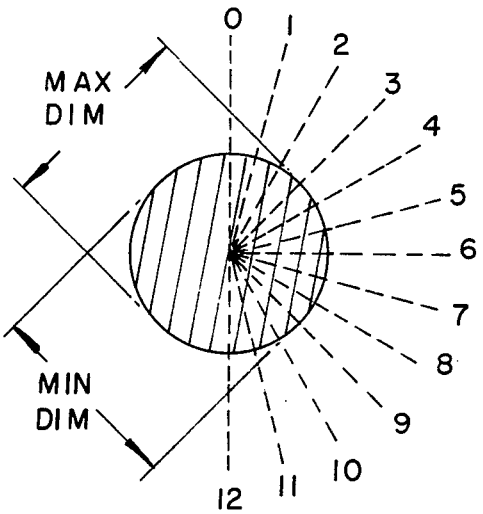
FIG. 5 is a cross-sectional view of an oval product section showing representative dimensions.

As illustrated in FIG. 5, twelve positions 15 degrees apart are graphically superimposed on a round product cross-section. To determine the maximum and minimum dimensions at each data section, three sets of twelve readings at each position are taken and averaged. These averaged dimensions are compared to pre-establish tolerance limits.

The type of metal being rolled will determine the specifics of the data input to control the process. The following example is based on the rolling of 1008 low carbon steel into a 5.50 to 5.55 mm diameter rod in a ten stand finishing block with the entry section measuring 17.00 mm average diameter. Tables I and II below set forth the process control parameters for this example.

TABLE I

| | AREA mm 2 | ROLL PRTNG mm. | PASS SHAPE | HEIGHT mm. | WIDTH ON FACE mm. | REDUC. % | TIME msec |
|---|---|---|---|---|---|---|---|
| 14a | 174.88 | 1.90 | O | 11.10 | 23.65 | 21.9 | 68.2 |
| 14b | 145.57 | 2.50 | R | 13.90 | 14.43 | 16.8 | 56.7 |
| 14c | 112.88 | 1.70 | O | 8.70 | 18.90 | 22.5 | 40.0 |
| 14d | 91.56 | 1.45 | R | 10.95 | 11.30 | 18.9 | 33.5 |
| 14e | 72.58 | 1.24 | O | 6.50 | 16.65 | 20.7 | 26.5 |
| 14f | 59.25 | 1.69 | R | 8.69 | 8.78 | 18.4 | 21.7 |
| 14g | 45.86 | 1.00 | O | 5.20 | 13.56 | 22.6 | 16.8 |
| 14h | 37.32 | 1.27 | R | 6.77 | 7.11 | 17.4 | 13.6 |
| 14i | 29.33 | 1.20 | O | 4.40 | 10.24 | 21.4 | 10.7 |

TABLE I-continued

| | AREA mm 2 | ROLL PRTNG mm. | PASS SHAPE | HEIGHT mm. | WIDTH ON FACE mm. | REDUC. % | TIME msec |
|---|---|---|---|---|---|---|---|
| 14j | 23.75 | 1.50 | R | 5.50 | 5.55 | 19.0 | |

Time (msec) is the time between stands except last stand.
Last stand time is time for full billet.

TABLE II

| | ROLL DIAM. mm. | WORK DIAM. mm. | SPEED M/sec. | ROLL SEPFRC Mton | ROLLING PWR KW | ROLL R/MIN | ROLLING TORQUE NM | BEARING TEMP deg (C.) |
|---|---|---|---|---|---|---|---|---|
| 14a | 210.5 | 207.96 | 11.73 | 10.06 | 381.1 | 1076.9 | 2917 | 54 |
| 14b | 210.5 | 201.61 | 14.10 | 7.06 | 336.9 | 1334.2 | 2025 | 49 |
| 14c | 210.5 | 209.45 | 18.18 | 7.32 | 436.2 | 1656.2 | 2180 | 53 |
| 14d | 158.75 | 156.71 | 22.41 | 4.21 | 373.4 | 2729.2 | 1111 | 57 |
| 14e | 158.75 | 161.16 | 28.27 | 4.43 | 485.9 | 3347.6 | 1156 | 51 |
| 14f | 158.75 | 159.33 | 34.63 | 3.01 | 412.08 | 4148.1 | 801 | 51 |
| 14g | 158.75 | 162.27 | 44.74 | 2.89 | 495.9 | 5262.1 | 786 | 53 |
| 14h | 158.75 | 160.91 | 54.98 | 2.01 | 427.3 | 6520.4 | 528 | 51 |
| 14i | 158.75 | 163.33 | 69.96 | 1.76 | 493.2 | 8175.3 | 486 | 52 |
| 14j | 158.75 | 162.48 | 86.36 | 1.19 | 404.6 | 10143.4 | 321 | 59 |

Work Diam. is effective working diameter or Roll Center distances minus delta groove.

Prior to commencing operation, the CPU memory is loaded with the target values for rod dimensions, bearing temperatures, roll separating forces, shaft torques and roll parting dimensions for each finishing stand. These target values are set forth in Tables I and II.

Rod dimension tolerance limits are established based ±0.15% of the target value. Upper tolerance limits for each stand are established for bearing temperature, roll separating force and shaft torque. Two sets of maximum and minimum limits are established for roll parting in each finishing stand. One set is to establish a window. Data within the limits of the window, zero to maximum, will be accepted for further processing. The limits of a window of a particular finishing stand are based upon 5.5 mm. In this example the limits for finishing stands 14*a–j* respectively would be ±0.15 mm. Data outside the window creates an alarm condition. The other set of limits is the actual distance within which the rolls can be adjusted. For finishing stands 14*a*–14*j* the total distance the work rolls can be moved is 1.5 mm. When a calculated roll parting adjustment exceeds the distance the rolls can actually move in order to make the adjustment an alarm condition is created. These limits and the programs shown as flow charts in FIGS. 6, 7, 7*a*, 7*b* and 7*c*; 9, 9*a*, 9*b* and 10, 10*a* and 10*b* and the subroutine shown in FIG. 8, are loaded into the CPU.

The operation of the preferred embodiment of the invention will be described with reference to FIGS. 6, 7, 7*a*, 7*b* and 7*c* and 8. The terms in the flow charts "LEADER" and "FINISHER" refer to finishing stands 14*i* and 14*j*, respectively.

The product commences to be rolled through the finishing stands after the CPU is initialized. The CPU scans the following input data: minimum and maximum dimensions of the product 20 from scanning laser 24, minimum and maximum dimensions of the product 20 from scanning laser 22; and bearing temperature, shaft torque, roll parting dimension and roll separating force from each finishing stand.

If an alarm condition is created, then depending upon the nature of the problem, rolling either may be allowed to continue or it may be interrupted. For example, if a bearing temperature is slightly above the maximum allowed, it may be possible to allow the remainder of the billet length to continue to be rolled before corrective action is initiated. On the other hand, if a roll fails, causing the product to suddenly become drastically off-gauge, the remaining billet length can be severed upstream of the finishing block and cropped into scrap pieces. If no alarm conditions are created, then before the product 20 enters finishing stand 14*a* and/or after the product 20 leaves finishing stand 14*j*, it presumably has maximum and minimum dimensions which are either within prescribed tolerance limits, or are capable of being brought within such limits by effecting appropriate mill adjustments.

Figure 6:
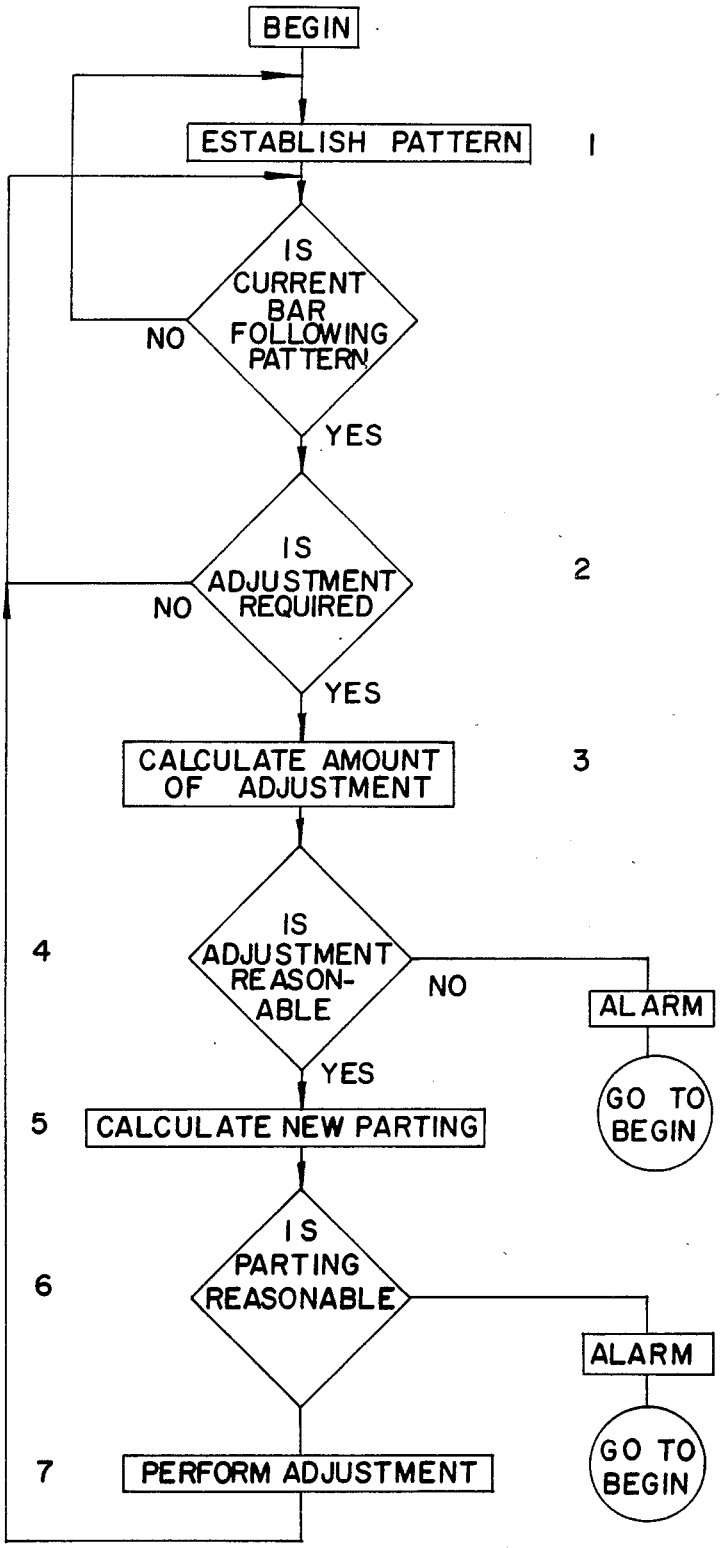
FIGS. 6; 7, 7*a*, 7*b* and 7*c*; 8; 9, 9*a* and 9*b*; and 10, 10*a* and 10*b* are flow charts of various embodiments of systems software.

Referring to FIGS. 2, 5 and 6, the maximum and minimum dimensions of the product 20 are measured at data station 16. Based on these read dimensions, three alternatives are presented: an alarm condition is created, the work rolls of the first finishing stand 14*a* are to be adjusted, or no change will be made to the work rolls of the finishing stand 14*a*. An alarm condition is created in two situations. One situation is when any reading of the minimum and maximum dimensions exceeds tolerance limits. The second is where the shape (pattern) of a billet is different from the shape of an immediately preceding billet.

The work rolls of the finishing stand 14*a* will adjust, if required, to produce a constant exiting cross-sectional area of product (measured in square millimeters) entering the next finishing stand 14*b*. The adjustments to the work rolls of the first finishing stand 14*a* overcome the effect that widely varying entering gauge would have on control of the exiting gauge of the product 20. Controlling the cross-sectional area of the product exiting the first finishing stand facilitates the control of the work roll adjustments of the downstream finishing stands.

Referring to FIG. 6, step 1, ESTABLISH PATTERN, a series of minimum and maximum dimensions are taken from a first billet passing through the data station 16. In the preferred embodiment, 120 such readings are taken one second apart. These readings are stored. A second billet passes through the data station 16 and similar readings are taken and compared to the first set of readings. If 95% of the readings of the second set are within ±0.5 percent of the readings first set, then the readings of the second set are considered acceptable. The first set of readings is discarded and the second set is stored. A third billet passes through the data station 16 and again readings are taken and compared to the stored set of readings. If within tolerance limits, then these readings from the third billet are accepted and stored. A pattern is established when two consecutive billets compare favorably, i.e. have the same shape based on the compared readings.

The dimensions read when a billet passes through the data station 16 are also compared to an established window and if the limits of the window are exceeded, an alarm condition is created. If the billet dimensions are within the window and a pattern has been established, then step 2, IS ADJUSTMENT REQUIRED, is executed. The calculated cross-sectional area of the billet entering the finishing stand 14*a* is compared to a preestablished window to determine if the work rolls must be adjusted. That is, the cross-sectional area of the billet may be on target and no adjustment is required, or alternatively, the cross-sectional area of the billet is within the window but an adjustment is required to insure that the product leaving the work rolls of the finishing stand 14*a* is on target. If an adjustment is required, then the amount of adjustment is calculated. Step 3, CALCULATE AMOUNT OF ADJUSTMENT is executed. This calculation is based on the cross-sectional area of the billet entering the first finishing stand and the target cross-sectional area of the product leaving the first finishing stand. Step 4, IS ADJUSTMENT REASONABLE, then is executed, i.e. the adjustment calculated is compared with the limits of a window previously established to determine if the adjustment is reasonable—is the data in a valid range. If YES, then Step 5, CALCULATE NEW PARTING, is executed. Subsequently, Step 6, IS PARTING REASONABLE, is executed. The calculated adjustment is compared to the actual position of the work rolls of the finishing stand 14*a*. If the work rolls are mechanically capable of moving the distance required, then Step 7, PERFORM ADJUSTMENT is executed and the work rolls are adjusted.

The product continues to roll through the finishing stands. If the dimensions of the product 20 at data station 18 are not within the tolerance limits, then three conditions are possible: first, the minimum and maximum dimensions may be larger than the tolerance limits; second, one of the two dimensions may not be within the tolerance limits; or third, both minimum and maximum dimensions may be smaller than the tolerance limits.

Figure 7:
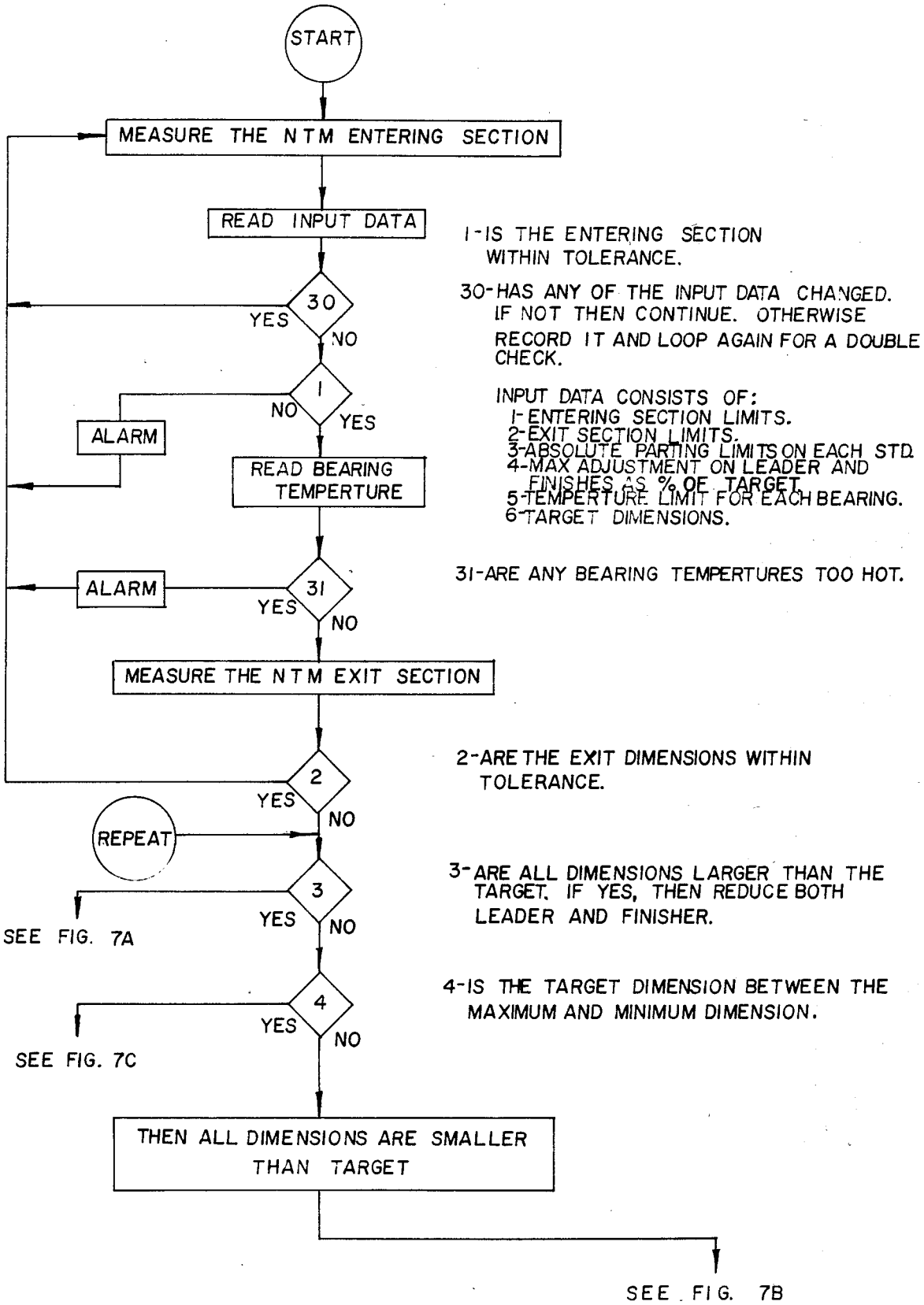
Figure 7A:
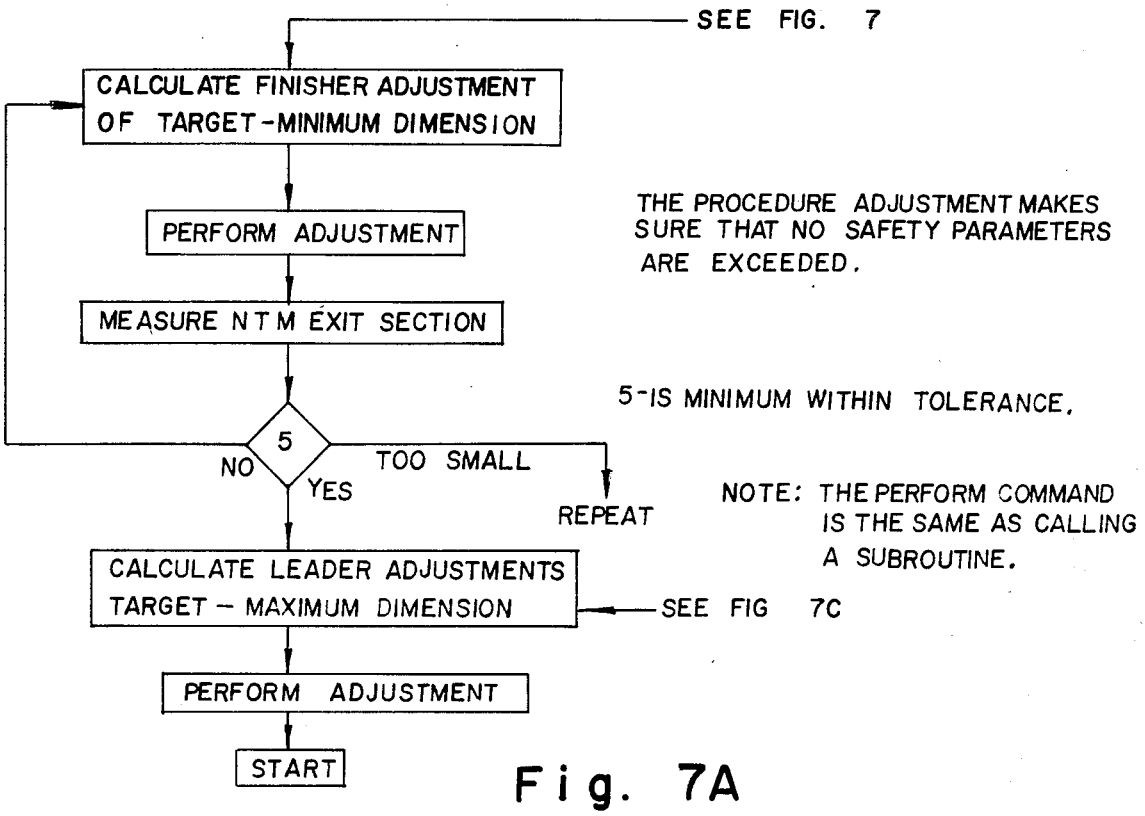
Figure 7B:
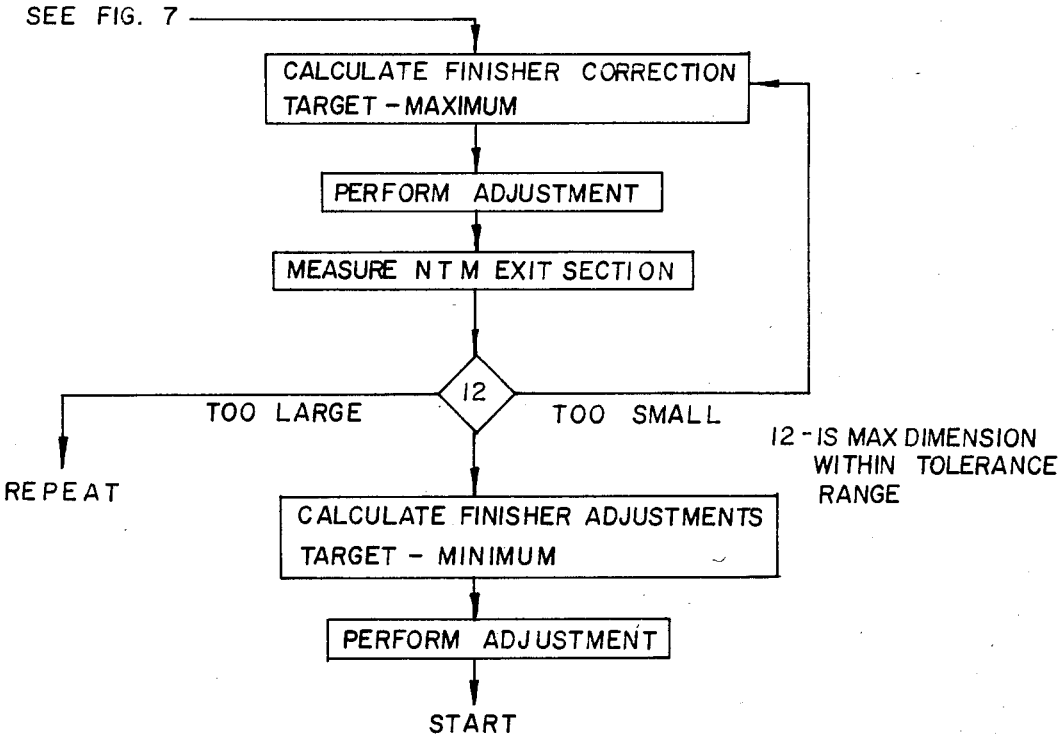
Figure 7C:
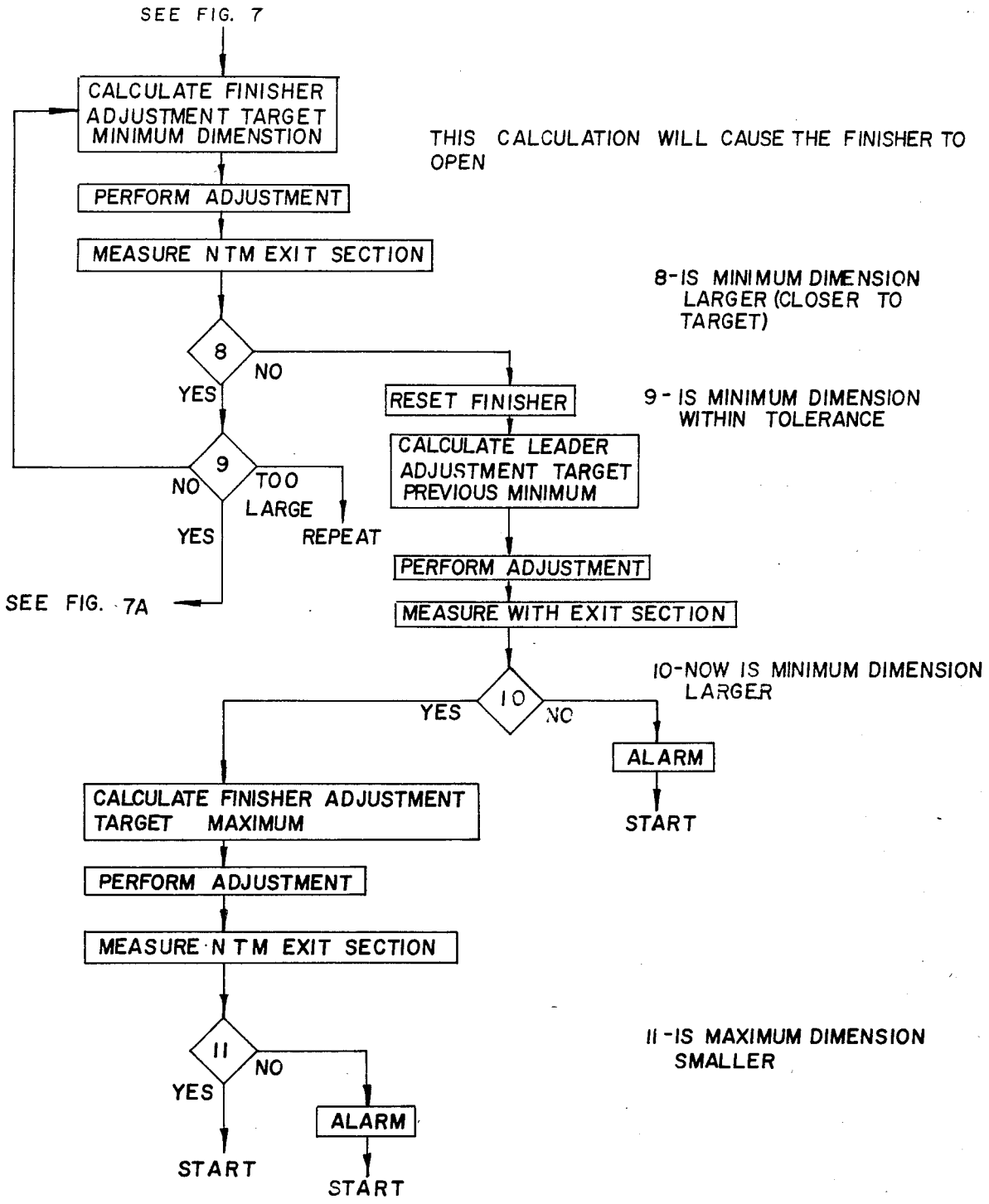
Figure 8:
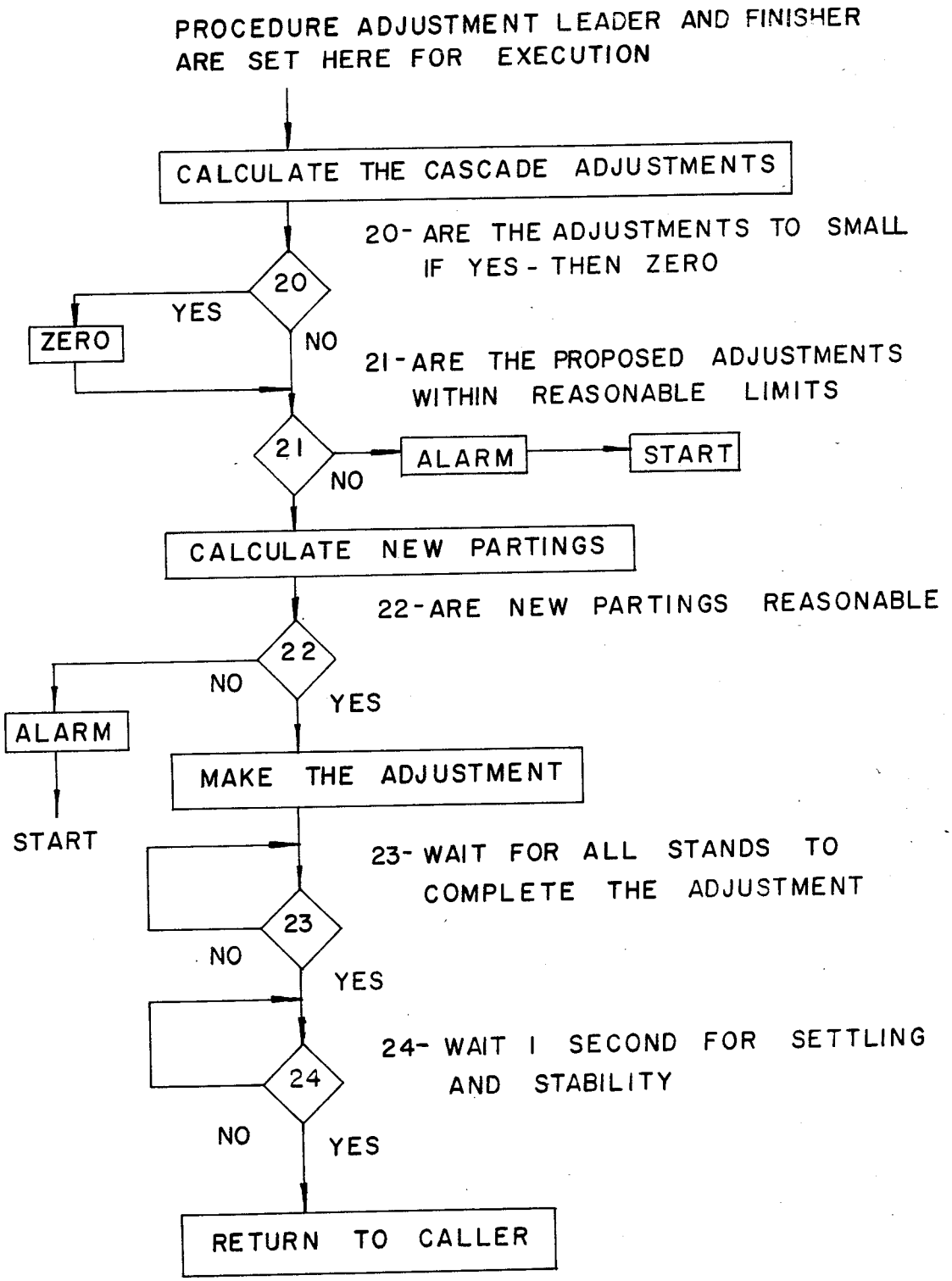

Under the first condition, where both dimensions are exceeded, Step 3 of FIG. 7 is executed. Assume the read dimensions are 6.00 mm and 5.60 mm. Referring to Table I, the target dimensions at roll stand 14*j* are 5.50 mm (minimum) and 5.55 mm (maximum). The step CALCULATE FINISHER ADJUSTMENT TARGET—MINIMUM DIAMETER of FIG. *7a* would determine that an adjustment of the roll parting between the work rolls of the finishing stand 14*j* of 0.10 mm (5.60 minus 5.50) is required to bring the minimum dimension onto target. The step "PERFORM ADJUSTMENT" of FIGS. *7a*, *7b* and *7c* illustrated in more detail in FIG. 8, is then executed, and the minimum and maximum dimensions of the exiting product at data station 18 are again read. If the minimum dimension is not brought into tolerance, then the CALCULATE FINISHER ADJUSTMENT TARGET—MINIMUM DIAMETER step is repeated as shown in FIG. *7a*. If for some reason the adjustment results in the minimum dimension being too small, that is, less than the established tolerable limits of the target dimensions, then the program shifts to repeat.

After the minimum diameter has been brought into tolerance, then the step CALCULATE LEADER ADJUSTMENTS TARGET—MAXIMUM DIMENSION is performed. This step is similar to that for CALCULATE FINISHER ADJUSTMENT etc., except that the PERFORM ADJUSTMENT step commences on the LEADER, finishing stand 14*i*. No adjustments are made to stand 14*j*.

If one of the product dimensions is within tolerance and the other is out of tolerance, then step 4, "YES", of FIG. 7 is executed. If both dimensions are smaller than target dimensions then step 4 "NO" is executed.

Where the step CALCULATE FINISHER ADJUSTMENTS etc., is executed prior to the PERFORM ADJUSTMENT step, the first roll parting adjustment commences with finishing stand 14*j*. Where the step CALCULATE LEADER ADJUSTMENTS etc. is executed prior to the PERFORM ADJUSTMENT step, the first parting roll adjustment commences with finishing stand 14*i*, no adjustments are made to the parting rolls of the finishing stand 14*j*.

The PERFORM ADJUSTMENT step in FIGS. *7a*, *7b* and *7c* calls for execution of the subroutine of FIG. 8. In this example a determination was made that the parting adjustment was to be 0.10 mm for work rolls of finishing stand 14*j*. The subroutine of FIG. 8 calculates the adjustments to be made to the work rolls of each of the finishing stands, CALCULATE THE CASCADE ADJUSTMENTS. Based on the 0.10 mm value the adjustments for the work rolls of stands 14*i*–*14a* are calculated based on a reciprocal geometric progression to the nearest hundredth of a millimeter. Thus for stand 14*i* the value would be 0.05 mm; for stand 14*h* 0.03; for stand 14*g* 0.01 mm etc. The calculated adjustments are analyzed in two steps. In step 21, the adjustments are compared with the limits of the window previously established to determine if the adjustments are reasonable; i.e., whether the data is within a valid range. If YES, then the calculated adjustments are compared to the data corresponding to the actual position of the work rolls of the finishing stands; step 22. If the work rolls can mechanically move the distance required to make the adjustment then work rolls are adjusted, MAKE THE ADJUSTMENT. This subroutine progressively distributes among the finishing stands the work required to be performed on the product to bring the product into tolerance.

With the program of FIGS. 7, *7a* *7b* and *7c* the dimensions of the product 20 are continously read and roll parting adjustments are made under load conditions.

Figure 9A:
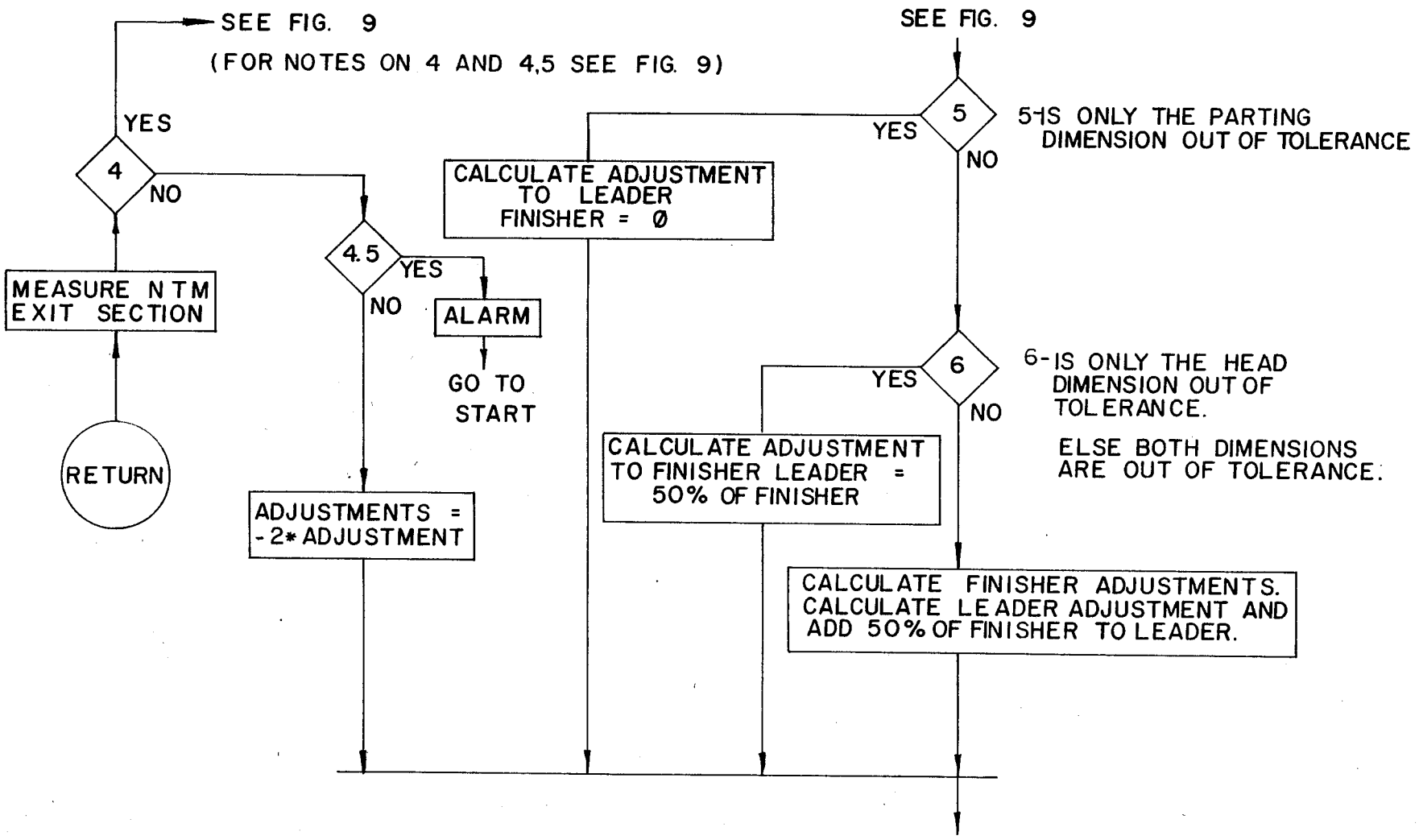
Figure 9B:
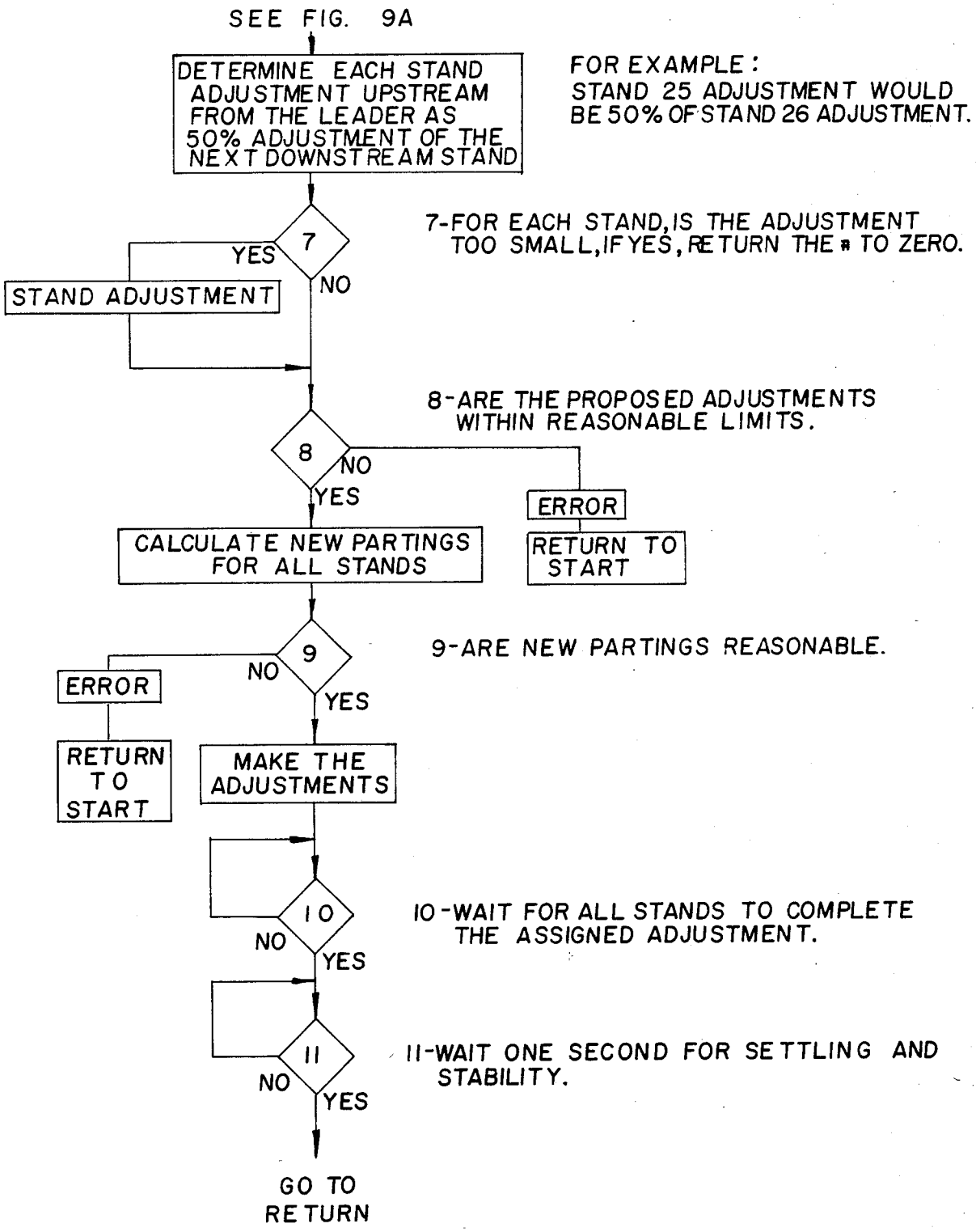

In FIGS. 9, *9a* and *9b* a program embodying an alternative embodiment of the invention is shown. This program assumes certain conditions and executes faster than the program of FIG. 7 if the assumptions are correct.

When the product 20 leaves the last finishing stand 14*j* (FINISHER) the two dimensions measured are the maximum and minimum dimensions. Typically the minimum dimension is the 'height' i.e., that dimension most responsive to the force imposed by the work rolls of the finishing stand 14*j*. This program assumes the minimum dimension is the 'height' dimension and the maximum dimension is the 'width' dimension; see FIG. 5. Step 4 YES will execute based upon the assumption a change in the smallest dimension will be caused by an adjustment of the work rolls of the stand 14*j*, (FINISHER), and a change in the largest dimension wall be caused by an adjustment in the work rolls of stand 14*i* (LEADER). If the assumption is incorrect then step 4.5 is executed which makes the correction that the smaller dimension is the 'width' and not the 'height'.

Figure 10:
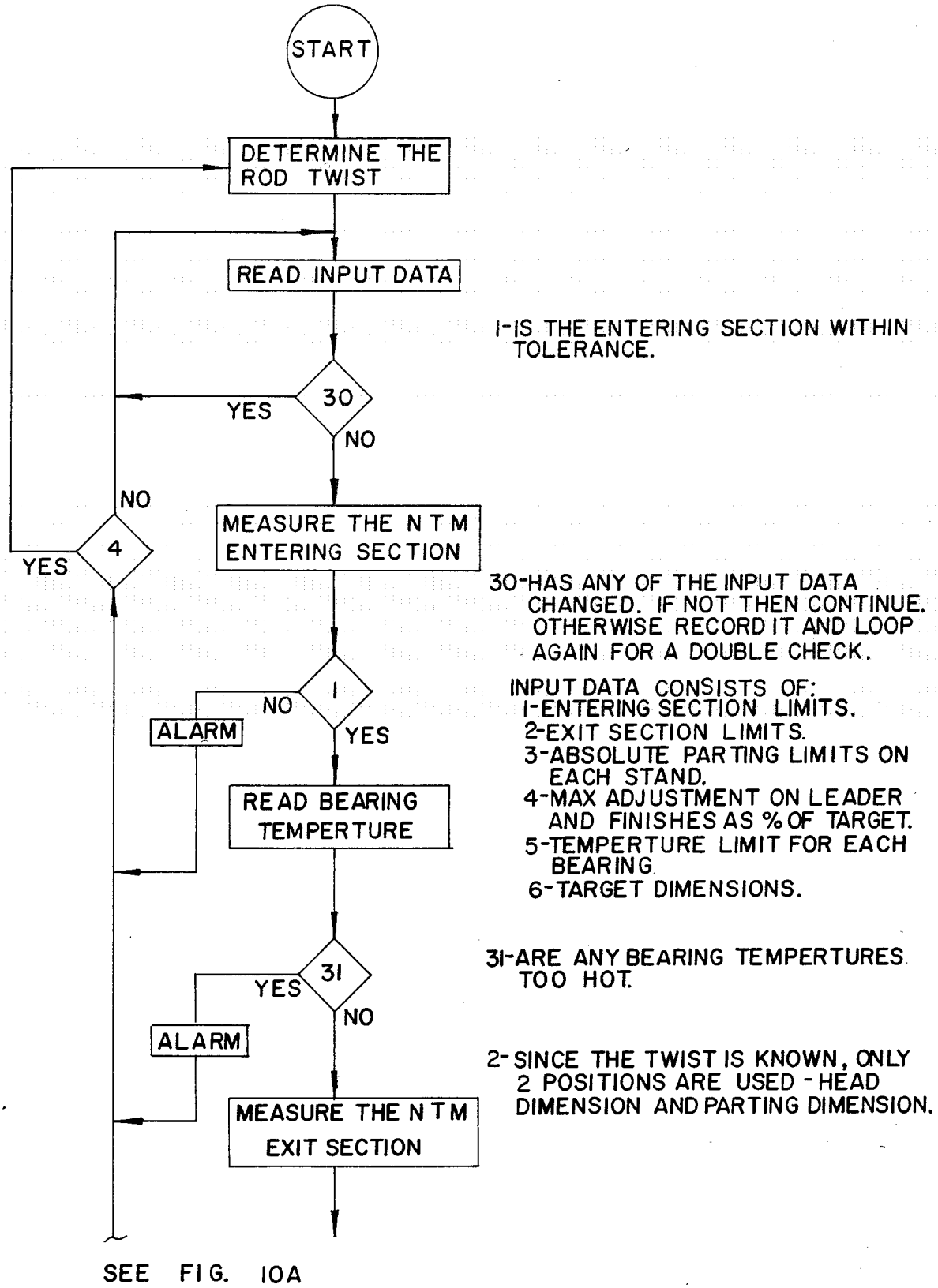
Figure 10A:
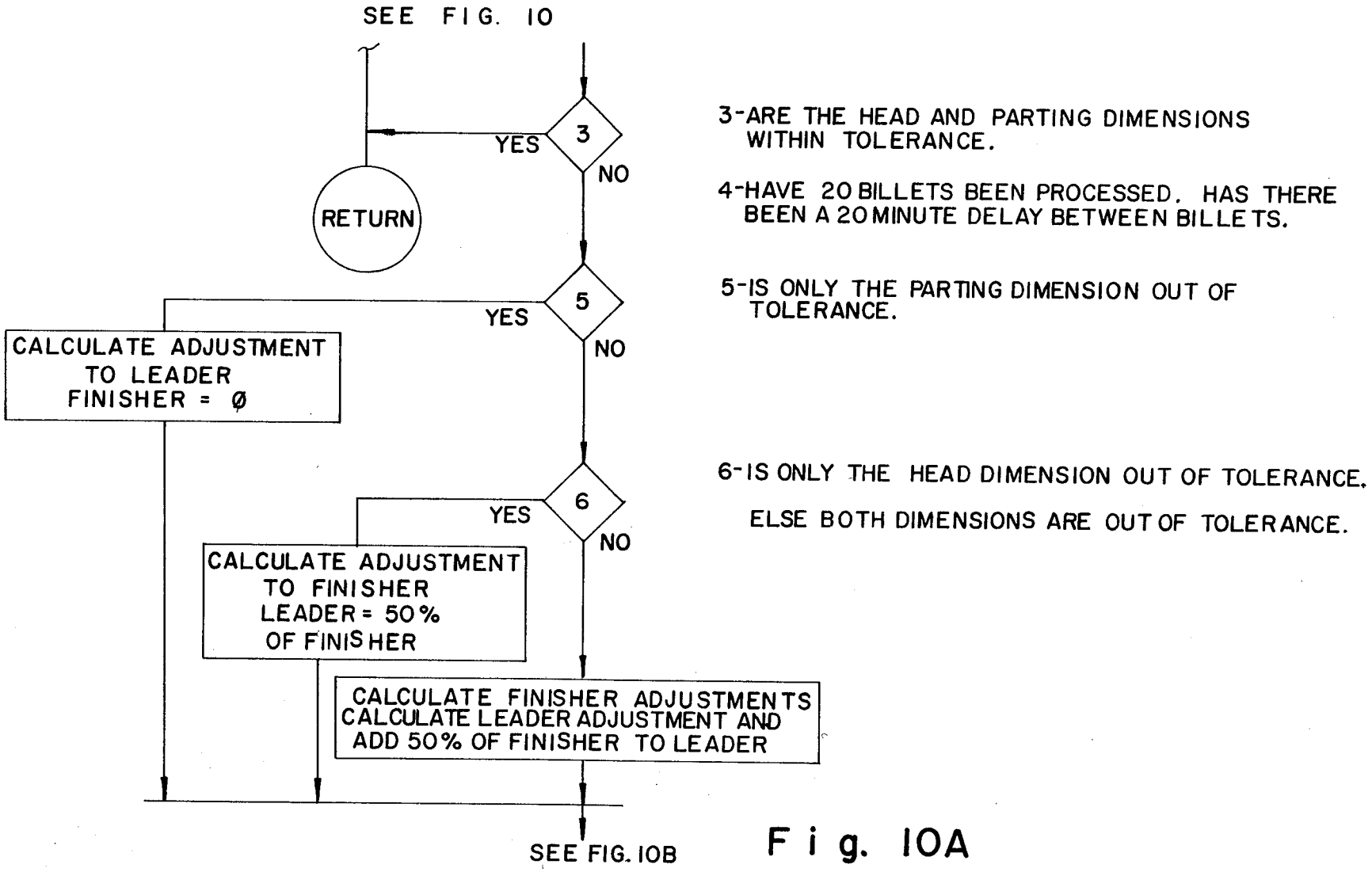
Figure 10B:
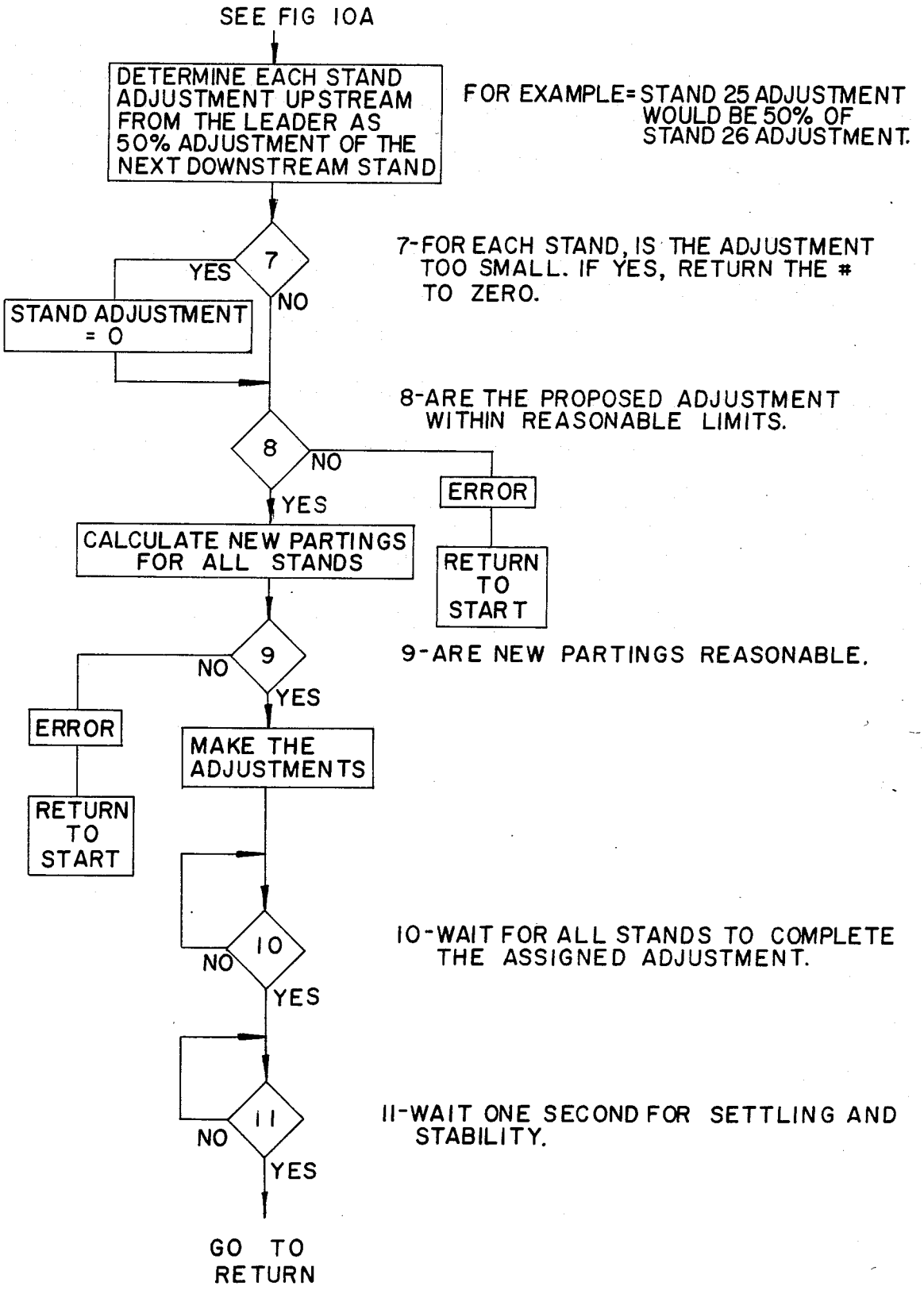

A still further embodiment of the invention is shown in FIGS. 10 10*a* and 10*b*. In this embodiment the maximum and minimum dimensions are continually measured based on the twist of the product after the product leaves the last finishing stand.

A frame of reference is established for the location of the minimum dimension and the maximum dimension of the rod at a fixed location in space. At data station 18, the laser gauge takes a set of 12 diameter readings at 15 degree intervals, see FIG. 5. Three such readings are taken and then averaged. An adjustment is made to the work rolls of the finishing stand 14*j*. Three more readings of twelve each are made, averaged and compared to the averaged readings before the adjustment to the work rolls of the finishing stand 14*j*. The one set of readings which decreased the most of the twelve readings is then determined to be the minimum dimension i.e., that dimension that is controlled most directly by the work roll adjustment. Those readings which are 90 degrees from the readings selected are determined to be the maximum diameter. Based on these determinations, all subsequent work roll adjustments are made as set forth in the flow chart. Once every twenty (20) billets or twenty minutes the rod twist is again determined.

The program is based on the assumption that the rod twist (position of minimum and maximum dimensions) will change, if at all, only slightly between rod twist determinations.

Having described the invention what we now claim is:

1. A method for controlling the gauge of a product being rolled through a rolling mill, which rolling mill has a plurality of successive mechanically interconnected finishing stands, each finishing stand having a pair of work rolls which define a roll pass, said work rolls driven by a common drive, which method includes:

rolling the product through the roll passes of the successive finishing stands;

measuring the transverse dimensions of the product exiting from the last finishing stand;

determining if the measured transverse dimensions of the exiting product are within preestablished limits and when said measured transverse dimensions are beyond said limits;

calculating an adjustment to the work rolls of at least one selected finishing stand, the said adjustment being that required to bring the transverse product dimensions within said limits, said selected finishing stand being downstream of the first finishing stand; based on the calculated adjustment to the work rolls of said selected finishing stand, calculating whether progressively smaller adjustments to the work rolls of additional selected finishing stands preceding said selected finishing stand are required; and determining if the calculated adjustments are feasible, and if feasible, performing said adjustments.

2. The method of claim 1 wherein said selected finishing stand is the last finishing stand.

3. The method of claim 2 which includes:

calculating in a reciprocal geometric progression the adjustments to the work rolls of the finishing stands preceding the last finishing stand.

4. The method of claim 1 wherein the said selected finishing stand is the next-to-last finishing stand.

5. The method of claim 4 which includes:

calculating in a reciprocal geometric progession the adjustments to the work rolls of the finishing stands preceding the next-to-last finishing stand.

6. The method of claims 2 or 4 wherein the determination if the calculated adjustments are feasible is a two-step determination which includes:

comparing the calculated adjustments to a first set of limits to determine if the calculated adjustments are reasonable; and comparing subsequently the calculated adjustments to data corresponding to the actual position of the work rolls to determine if the calculated adjustments are achievable.

7. The method of claim 1 which includes: p1 measuring the dimensions of the product before it enters the first finishing stand; and determining if the entering product exceeds preestablished limits.

8. The method of claim 1 which includes:

passing a first billet through a data station;

reading the dimensions of the billet plurality times as it passes through the data station;

storing the read dimensions as the pattern of the first billet;

moving a second billet through the data station;

reading the dimensions of the second billet plurality times as it passes through the data station;

comparing the dimensions of the second billet to the stored dimensions; and determining if the second billet has the same pattern as the first billet based on the compared dimensions.

9. The method of claim 8 which includes:

calculating an adjustment to the work rolls of the first finishing stand,the adjustment necessary to bring the product exiting the work rolls of said first finishing stand into tolerance; and determining if the calculated adjustment is feasible and if feasible, adjusting said work rolls.

* * * * *